US011609592B2

(12) United States Patent
Reichelt

(10) Patent No.: US 11,609,592 B2
(45) Date of Patent: Mar. 21, 2023

(54) FAST START-UP BIAS CIRCUITS

(71) Applicant: Disruptive Technologies Research AS, Blomsterdalen (NO)

(72) Inventor: Pål Øyvind Reichelt, Sandvika (NO)

(73) Assignee: Disruptive Technologies Research AS

( * ) Notice: Subject to any disclaimer, the term of this patent is extended or adjusted under 35 U.S.C. 154(b) by 0 days.

(21) Appl. No.: 15/400,382

(22) Filed: Jan. 6, 2017

(65) Prior Publication Data

US 2017/0308112 A1 Oct. 26, 2017

Related U.S. Application Data

(60) Provisional application No. 62/275,358, filed on Jan. 6, 2016.

(51) Int. Cl.
*G05F 3/26* (2006.01)

(52) U.S. Cl.
CPC ..... *G05F 3/26* (2013.01); *G05F 3/262* (2013.01)

(58) Field of Classification Search
CPC ..... G05F 3/26; G05F 3/262; G05F 1/468; H02M 1/36
USPC ..... 323/315, 317, 901; 363/49
See application file for complete search history.

(56) References Cited

U.S. PATENT DOCUMENTS 6,377,112 B1 * 4/2002 Rozsypal ..... H01L 27/0921 327/534
9,312,747 B1 * 4/2016 Svorc ..... H02M 1/36
9,710,008 B2 * 7/2017 Svorc ..... G05F 3/26
2009/0085654 A1 4/2009 Lin
2009/0146733 A1 * 6/2009 Nakajikkoku ..... G05F 3/262 327/543
2014/0306751 A1 * 10/2014 Nakamoto ..... G05F 1/10 327/541

FOREIGN PATENT DOCUMENTS

EP 0994403 A1 4/2000
EP 2354882 A1 8/2011
EP 2779452 B1 8/2018

OTHER PUBLICATIONS

Written Opinion of International Search Authority for International Application No. PCT/IB2017/000340, dated Jun. 9, 2017, 5 pages.

* cited by examiner

*Primary Examiner* — Adolf D Berhane
(74) *Attorney, Agent, or Firm* — Onyx IP Group

(57) ABSTRACT

A bias circuit is provided. The bias circuit may include a first transistor forming an input node, a second transistor forming an output node, and a switch array disposed between the first transistor and the second transistor. The switch array may be configured to charge the first transistor to a supply voltage and the second transistor to a ground during a first mode of operation, and couple the first transistor to the second transistor to approximate a final bias voltage during a second mode of operation.

17 Claims, 3 Drawing Sheets

FAST START-UP BIAS CIRCUITS

TECHNICAL FIELD

The present disclosure relates generally to low power electronic devices, and more particularly, to bias circuits with faster start-up designed for low power electronics.

BACKGROUND

Duty cycling is common in mobile devices, portable devices, or other battery-operated electronic devices for its low power consumption and efficiency. Such benefits can be optimized by shortening the start-up period of the duty cycle relative to the operational period of the duty cycle. This is especially challenging in bias circuits for current references and current mirrors. Bias circuits in current references and current mirrors tend to have substantially long start-up periods due to the amount of settling involved in establishing the appropriate bias voltage levels. A number of conventional techniques are currently available, all of which serve to disable the bias circuit and cut the flow of current therethrough. Although such conventional techniques may be adequate for most uses, there is still much room for improvement.

A first convention pulls the N-type metal-oxide semiconductor (NMOS) gate voltages in a biasing circuit to ground, and pulls the P-type metal-oxide semiconductor (PMOS) gate voltages to a supply voltage to directly switch off any current flowing through the bias circuit. However, because all currents start from zero, it can take very long time to charge all of the node capacitances. A second convention with faster start-up time pulls the NMOS gate voltages to a supply voltage and the PMOS gate voltages to ground and uses separate transistors at the source or drain to switch off the current. Because the parasitic capacitance of the gates will be charged to a voltage representing full conduction, the transistors will have a much lower impedance than in the first convention, and therefore settle towards steady-state operation much quicker. However, the current during start-up before settling can be many decades greater than the final bias current after settling, which can lead to more wasted energy. This technique can also complicate the design of other circuits within the system because it may be much more difficult to know when the bias current will be usable for the designated purpose.

A third convention attempts to preserve as much of the charge on the biasing nodes by making them float, and use separate transistors on the drain and the source connections to cut the flow of current. However, the node voltages can often drift off mark, and the length of the start-up periods can be highly dependent on parameters, such as duty cycle, temperature, and the like. There are also risks of introducing inter-symbol interference or other adverse effects due to errors carrying on from cycle to cycle. Accordingly, there is a need to further reduce power consumption in low power electronics and make duty cycling even more efficient. Moreover, there is a need to utilize existing capacitive charges and establish bias voltages in bias circuits based on some priori knowledge of supply voltages and bias voltages so as to enable quicker start-up.

The present disclosure is directed at addressing one or more of the deficiencies and disadvantages set forth above. However, it should be appreciated that the solution of any particular problem is not a limitation on the scope of this disclosure or of the attached claims except to the extent expressly noted.

SUMMARY OF THE DISCLOSURE

In one aspect of the present disclosure, a bias circuit is provided. The bias circuit may include a first transistor forming an input node, a second transistor forming an output node, and a switch array disposed between the first transistor and the second transistor. The switch array may be configured to charge the first transistor to a supply voltage and the second transistor to a ground during a first mode of operation, and couple the first transistor to the second transistor to approximate a final bias voltage during a second mode of operation.

In another aspect of the present disclosure, a current mirror is provided. The current mirror may include an input transistor coupled to an input node and driven by an input gate, an output transistor coupled to an output node and driven by an output gate, and a switch array disposed between the input transistor and the output transistor. The switch array may be configured to selectively couple the input gate to the output gate in an enabling mode of operation, and selectively decouple the input gate from the output gate in a disabling mode of operation.

In yet another aspect of the present disclosure, a method of providing a bias circuit is provided. The method may include charging a first gate of a first transistor to a supply voltage, charging a second gate of a second transistor to a ground, decoupling the first gate from the second gate during a disabling mode of operation, and coupling the first gate to the second gate during an enabling mode of operation.

These and other aspects and features will be more readily understood when reading the following detailed description in conjunction with the accompanying drawings.

While the following detailed description is given with respect to certain illustrative embodiments, it is to be understood that such embodiments are not to be construed as limiting, but rather the present disclosure is entitled to a scope of protection consistent with all embodiments, modifications, alternative constructions, and equivalents thereto.

DETAILED DESCRIPTION

Figure 1:
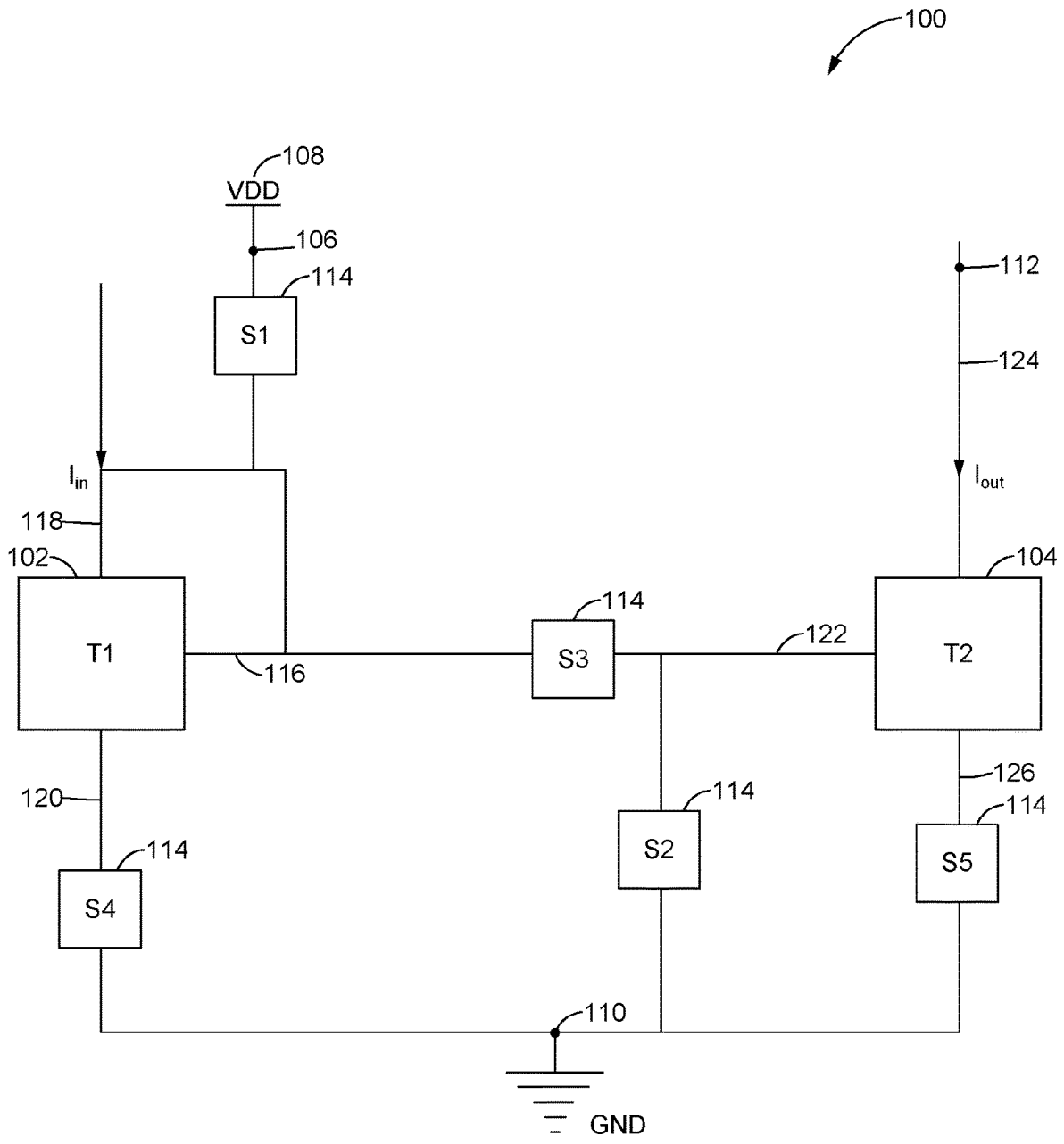
FIG. 1 is a schematic view of one generalized and exemplary embodiment of a fast start-up bias circuit of the present disclosure.

Referring to FIG. 1, one generalized embodiment of a bias circuit 100 is diagrammatically provided. The bias circuit 100 may be used in association with devices, such as battery-operated electronic devices, which rely on duty cycling to achieve lower power consumption and longer battery lifetimes. While other applications and arrangements may be possible, the bias circuit 100 may be most commonly implemented in the form of current reference circuits, current mirror circuits, or other circuits which typically require longer settling times to establish appropriate bias voltage levels while working with ultra low currents. Moreover, the bias circuit 100 of the present disclosure may be used to overcome the delays due to parasitic capacitances, such as by providing charge-sharing between parasitic capacitances, and thereby establish estimated bias voltages almost instantaneously at the start of an on-cycle.

As shown in FIG. 1, the bias circuit 100 may generally include at least a first transistor 102 and a second transistor 104. In particular, the first transistor 102 may be an input transistor that is coupled between an input or reference node 106 of the bias circuit 100, such as a supply voltage 108, and a ground node 110. The second transistor 104 may be an output transistor that is coupled between an output node 112 of the bias circuit 100 and the ground node 110. Furthermore, each of the transistors 102, 104 may represent bipolar junction transistors (BJTs), field effect transistors (FETs), as well as variations or sub-categories thereof. Also, while the bias circuit 100 of FIG. 1 is shown with only two transistors 102, 104, it will be understood that this is for simplicity and illustrative purposes only. Other arrangements, such as bias circuits 100 with more than two transistors 102, 104, or with multiple pairs of transistors 102, 104 may also be implemented.

Still referring to FIG. 1, the bias circuit 100 may further include a switch array 114 that is electrically disposed between the input or first transistor 102 and the output or second transistor 104. In the embodiment shown, the switch array 114 may be configured to selectively couple each of the transistors 102, 104 to one another and/or to one of a supply voltage 108 or a ground node 110 in accordance with a plurality of different modes of operation. For example, in a first mode of operation, the switch array 114 may be configured to charge one of the first transistor 102 and the second transistor 104 to the supply voltage 108 via the reference node 106, and charge the remaining one of the first transistor 102 and the second transistor 104 to ground via the ground node 110. In a second mode of operation, the switch array 114 may be configured to couple the first transistor 102 to the second transistor 104 to approximate a final bias voltage therebetween.

As shown in FIG. 1, the first transistor 102 may include a first gate 116, a first drain 118 and a first source 120, and the second transistor 104 may include a second gate 122, a second drain 124 and a second source 126. Moreover, the first drain 118 may be coupled to the supply voltage 108 via the reference node 106, and the first source 120 may be coupled to ground via the ground node 110, while the first gate 116 may be used to drive or operate the first transistor 102. Correspondingly, the second drain 124 may be coupled to the output node 112, and the second source 126 may be coupled to ground via the ground node 110, while the second gate 122 may be used to drive or operate the second transistor 104. During the first mode of operation, the first gate 116 and the second gate 122 may be decoupled from one another, but independently charged to the supply voltage 108 and the ground node 110. During the second mode of operation, the first gate 116 may be coupled to the second gate 122 so as to initiate charge-sharing therebetween and approximate a final bias voltage.

The switch array 114 of FIG. 1 may include one or more switches configured to charge a parasitic capacitance of at least one of the first transistor 102 and the second transistor 104 to the supply voltage 108, and charge a parasitic capacitance of the remaining one of the first transistor 102 and the second transistor 104 to the ground node 110 during the first mode of operation. The switch array 114 may additionally include one or more switches coupled to one or more of the first transistor 102 and the second transistor 104 in a manner configured to selectively disable current therethrough during the first mode of operation. For example, the switch array 114 may provide switches disposed on any one or more of the first drain 118, the first source 120, the second drain 124, the second source 126, or any other location capable of disabling current through the bias circuit 100 and between the transistors 102, 104. The switch array 114 may further include switches capable of enabling current through the bias circuit 100 and between the transistors 102, 104 during the second mode of operation.

Figure 2:
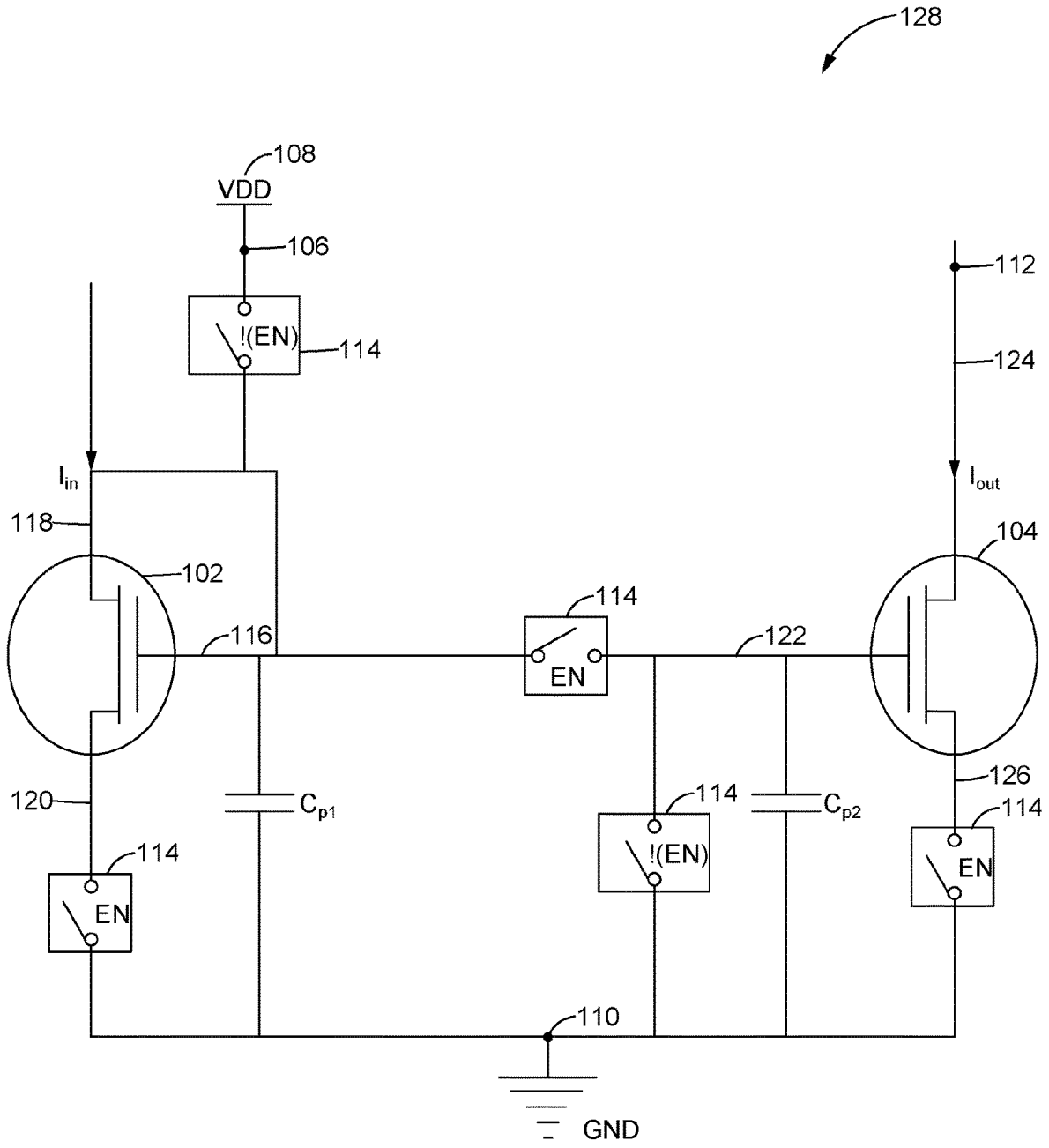
FIG. 2 is a schematic view of one exemplary embodiment of a current mirror implementing the fast start-up bias circuit of the present disclosure.

Turning to FIG. 2, one exemplary implementation of the bias circuit 100 of FIG. 1, such as in the form of a current mirror 128, is provided. As shown, and similar to the bias circuit 100 of FIG. 1, the current mirror 128 may include an input transistor 102, an output transistor 104, and a switch array 114 disposed therebetween. Specifically, the input transistor 102 may be coupled to an input node 106 of the current mirror 128 and driven by an input gate 116, and the output transistor 104 may be coupled to an output node 112 of the current mirror 128 and driven by an output gate 122. The switch array 114 may be configured to selectively couple the input gate 116 to the output gate 122 in an enabling mode of operation, and selectively decouple the input gate 116 from the output gate 122 in a disabling mode of operation. Moreover, during the disabling mode of operation, the switch array 114 may be configured to charge one of the gates 116, 122 to the supply voltage 108, and charge the remaining one of the gates 116, 122 to the ground node 110.

As in previous embodiments, the input transistor 102 of the current mirror 128 of FIG. 2 may include an input drain 118 that is coupled to the supply voltage 108 via the input node 106, and an input source 120 that is coupled to a ground node 110, while the output transistor 104 may include an output drain 124 that is coupled to the output node 112 and an output source 126 that is coupled to a ground or ground node 110. The switch array 114 may include at least one switch that is coupled to one or more of the transistors 102, 104 and configured to selectively disable current therethrough. Moreover, in the disabling mode of operation, the switch array 114 may charge a parasitic capacitance of the input transistor 102 to the supply voltage 108, charge a parasitic capacitance of the output transistor 104 to the ground node 110, and disable current therebetween. In the enabling mode of operation, the switch array 114 may initiate charge-sharing to establish a voltage therebetween that is scaled to approximate a final bias voltage.

In further modifications to the current mirror 128 of FIG. 2, an additional capacitance may be added in parallel to the parasitic capacitances of the input transistor 102 and the output transistor 104 to provide more refined control of the resulting final bias voltage once charge-sharing is complete. The added capacitance may help to compensate or correct final bias voltages due to simple charge-sharing that are otherwise too high or too low for the given supply voltage 108 and threshold voltages of the transistors 102, 104. In other modifications, programmable switches may be provided to selectively connect different areas of the bias circuit 100 or current mirror 128 to either the supply voltage 108 or to the ground node 110 during the disabling mode of operation. Such programmable switches may be used to fine-tune the final bias voltage even more precisely in response to any variations in the supply voltage 108 and/or process- or temperature-dependent threshold voltages.

Figure 3:
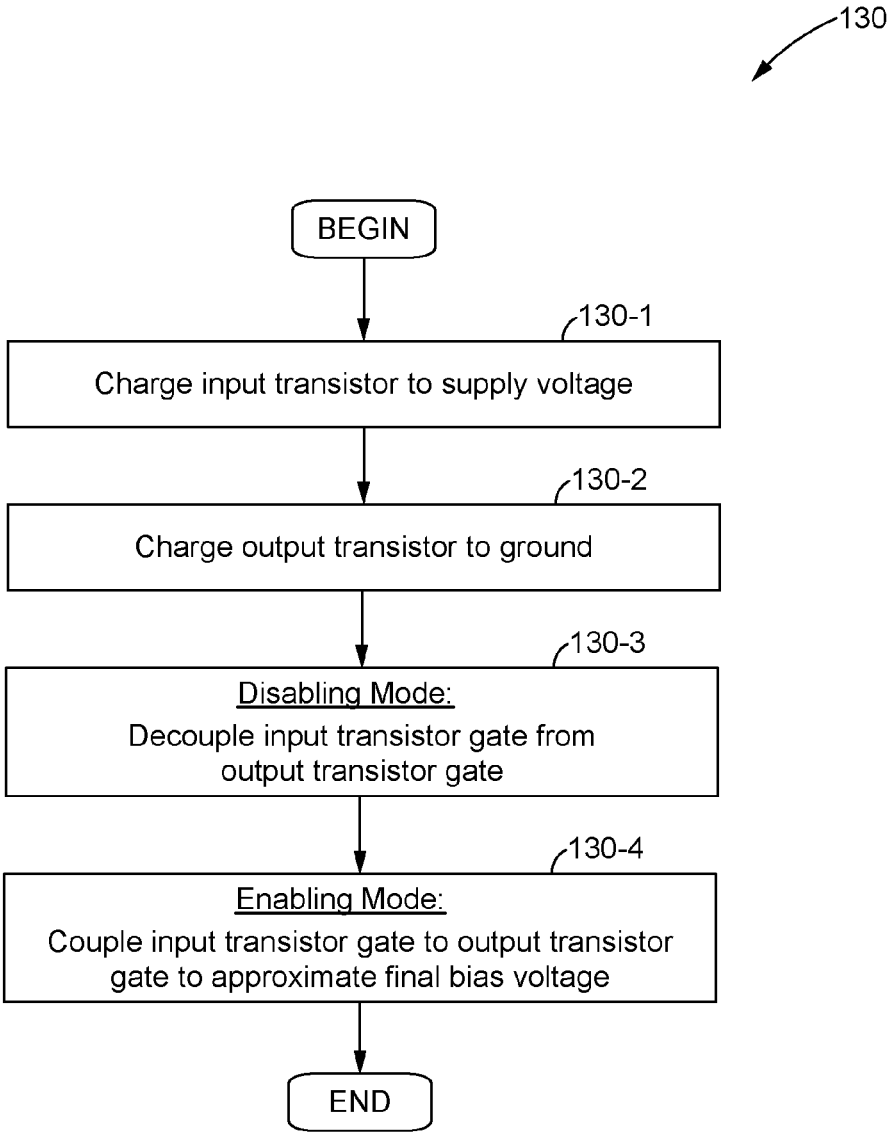
FIG. 3 is a flow diagram of one exemplary scheme or method of providing a bias circuit in accordance with the teachings of the present disclosure.

Referring now to FIG. 3, one exemplary method 130 of providing a bias circuit 100 is provided. As shown in FIG.

3, and with reference to the current mirror 128 of FIG. 2 for instance, the method 130 in block 130-1 may initially charge the input transistor 102, or a parasitic capacitance thereof, to the supply voltage 108. The method 130 in block 130-2 may also charge the output transistor 104, or a parasitic capacitance thereof, to ground or the ground node 110. As discussed above, the method 130 may charge the transistors 102, 104 via the respective gates 116, 122 thereof. Also, in other embodiments, the method 130 may alternatively charge the input transistor 102 to ground or the ground node 110 in block 130-1, and charge the output transistor 104 to the supply voltage 108 in block 130-2. Still further alternative arrangements are also possible, so long as at least one of the transistors 102, 104 is charged to the supply voltage 108, and at least one of the remaining transistors 102, 104 is charged to the ground node 110.

As further shown in FIG. 3, the method 130 in block 130-3 may perform in a disabling mode of operation that is configured to decouple the input transistor 102 from the output transistor 104. More specifically, during the disabling mode of operation, the method 130 may decouple the input gate 116 from the output gate 122, such as via the switch array 114 of FIG. 2, to eliminate any current flow therebetween. The method 130 in block 130-4 may also perform an enabling mode of operation that is configured to couple the input transistor 102 to the output transistor 104 to enable current and approximate a final bias voltage therebetween. Specifically, the method 130 in block 130-4 may couple the input gate 116 to the output gate 122 to initiate charge-sharing therebetween. For example, the parasitic capacitance of the input transistor 102 previously charged to the supply voltage 108 charge-shares with the parasitic capacitance of the output transistor 104 to settle and establish the desired final bias voltage therebetween.

It will be understood that the method 130 shown in FIG. 3 is demonstrative of only one exemplary set of processes configured to provide and enable a bias circuit 100 or a current mirror 128 as discussed further above, and that other variations of the method 130 will be apparent to those of ordinary skill in the art. Furthermore, any one or more of the processes of the method 130 shown in FIG. 3 may be reiterated as needed for the given application, and any one or more of the processes of the method 130 may be performed in different sequences than shown and still provide comparable results. Also, while the method 130 of FIG. 3 is directed to a bias circuit 100 or current mirror 128 with two transistors 102, 104, it will be understood that bias circuits 100 or current mirrors 128 having more than two transistors 102, 104 and other arrangements are possible so long as at least one of the transistors 102, 104 is charged to a supply voltage 108 and at least one of the remaining transistors 102, 104 is charged to ground or a ground node 110.

From the foregoing, it will be appreciated that while only certain embodiments have been set forth for the purposes of illustration, alternatives and modifications will be apparent from the above description to those skilled in the art. These and other alternatives are considered equivalents and within the spirit and scope of this disclosure and the appended claims.

What is claimed is:

1. A bias circuit, comprising:

a first transistor forming an input node;

a second transistor forming an output node; and a switch army disposed between the first transistor and the second transistor, wherein the switch array is configured to charge the first transistor to a supply voltage and the second transistor to a ground during a first mode of operation, and couple the first transistor to the second transistor to approximate a final bias voltage during a second mode of operation, wherein the first transistor is driven by a first gate and the second transistor is driven by a second gate, and wherein the switch array is configured to, selectively decouple the first gate from the second gate in the first mode of operation, and selectively couple the first gate to the second gate in the second mode of operation.

2. The bias circuit of claim 1, wherein the switch array is configured to couple the first gate to the supply voltage and couple the second gate to the ground during the first mode of operation.

3. The bias circuit of claim 1, wherein the first transistor includes a first drain coupled to the input node and the supply voltage, and a first source coupled to the ground, and the second transistor includes a second drain coupled to the output node and a second source coupled to the ground.

4. The bias circuit of claim 1, wherein the switch array includes at least one switch coupled to one or more of the first transistor or the second transistor in a manner configured to selectively disable current therethrough in the first mode of operation.

5. The bias circuit of claim 1, wherein, in the first mode of operation, the switch array is configured to charge a parasitic capacitance of the first transistor to the supply voltage, charge a parasitic capacitance of the second transistor to the ground, and disable current between the first transistor and the second transistor.

6. The bias circuit of claim 1, wherein, in the second mode of operation, the switch array is configured to initiate charge-sharing between the first transistor and the second transistor, and establish a voltage therebetween scaled to approximate the final bias voltage.

7. A current mirror, comprising:

an input transistor coupled to an input node and driven by an input gate;

an output transistor coupled to an output node and driven by an output gate; and a switch array disposed between the input transistor and the output transistor, wherein the switch array is configured to selectively couple the input gate to the output gate in an enabling mode of operation, and to selectively decouple the input gate from the output gate in a disabling mode of operation, and wherein, in the disabling mode of operation, the switch array is configured to parasitic capacitance of the output transistor to a ground, and disable current between the input transistor and the output transistor.

8. The current mirror of claim 7, wherein the input gate is coupled to a supply voltage and the output gate is coupled to a ground.

9. The current mirror of claim 7, wherein the input gate is coupled to a ground and the output gate is coupled to a supply voltage.

10. The current mirror of claim 7, wherein the input transistor includes an input drain coupled to the input node and a supply voltage, and an input source coupled to a ground, and wherein the output transistor includes an output drain coupled to the output node and an output source coupled to the ground.

11. The current mirror of claim 7, wherein the input transistor includes an input drain and an input source, herein the output transistor includes an output drain and an output source, wherein the switch array include at least one switch coupled to one or more of the input drain, the input source, the output drain or the output source, and wherein the switch array is configured to selectively disable current between the input transistor and the output transistor in the disabling mode of operation.

12. The current mirror of claim 7, wherein, in the enabling mode of operation, the switch array is configured to initiate charge-sharing between the input gate and the output gate, and establish a voltage therebetween scaled to approximate a final bias voltage.

13. A method of providing a bias circuit, the method comprising:

charging a first gate of a first transistor to a supply voltage;

charging a second gate of a second transistor to a ground;

decoupling the first gate from the second gate during a disabling mode of operation; and coupling the first gate to the second gate during an enabling mode of operation, wherein the enabling mode of operation initiates charge-sharing between the first gate and the second gate to establish a voltage therebetween scaled to approximate a final bias voltage.

14. The method of claim 13, wherein the first gate is charged to the supply voltage via a reference node, and the second gate is charged to the ground via a ground node.

15. The method of claim 13, wherein the disabling mode of operation disables substantially all current through the bias circuit.

16. The method of claim 13, wherein the enabling mode of operation approximates a final bias voltage between the first gate and the second gate.

17. The method of claim 13, wherein the disabling mode of operation charges a parasitic capacitance of the first transistor to the supply voltage, charges a parasitic capacitance of the second transistor to ground, and disables current between the first transistor and the second transistor.

* * * * *